US007721929B2

(12) United States Patent
Yoshie

(10) Patent No.: US 7,721,929 B2
(45) **Date of Patent: *May 25, 2010**

(54) STAPLE CARTRIDGE

(75) Inventor: Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 18 days.

This patent is subject to a terminal disclaimer.

(21) Appl. No.: 12/453,157

(22) Filed: Apr. 30, 2009

(65) Prior Publication Data

US 2009/0212087 A1 Aug. 27, 2009

Related U.S. Application Data

(63) Continuation of application No. 10/495,551, filed on May 14, 2004.

(30) Foreign Application Priority Data

Nov. 15, 2001 (JP) ..... P. 2001-350669
Nov. 19, 2001 (JP) ..... P. 2001-353716
Nov. 28, 2001 (JP) ..... P. 2001-363321

(51) Int. Cl.
*B27F 7/00* (2006.01)

(52) U.S. Cl. ..... 227/120; 227/131; 227/135; 227/136; 227/156

(58) Field of Classification Search ..... 227/120
See application file for complete search history.

(56) References Cited

U.S. PATENT DOCUMENTS 4,623,082 A 11/1986 Kurosawa
5,346,114 A 9/1994 Udagawa et al.
5,501,387 A 3/1996 Yoshie
5,560,529 A 10/1996 Udagawa et al.
6,039,230 A 3/2000 Yagi et al.
6,050,471 A 4/2000 Yagi
6,112,939 A 9/2000 Yoshie
6,216,936 B1 4/2001 Abe
6,484,921 B2 11/2002 Hakozaki et al.
2003/0066922 A1 4/2003 Hoge

FOREIGN PATENT DOCUMENTS

EP 0838315 A2 4/1998
JP 60-61178 4/1985
JP 62-74581 4/1987
JP 62-218079 9/1987
JP 6-210579 8/1994

(Continued)

*Primary Examiner*—Rinaldi I. Rada
*Assistant Examiner*—Nathaniel Chukwurah
(74) *Attorney, Agent, or Firm*—Morgan, Lewis & Bockius LLP

(57) ABSTRACT

An opening portion (104) is formed at a rear face of a staple cartridge (103), a slide door (106) is provided at the opening portion (104), and the slide door (106) is maintained at a closing position by a tension coil spring (107). When the slide door (106) is pushed down, also a pressing plate (109) is moved down by being pushed by the slide door, the opening portion (104) is opened and a staple pack (121) can be inserted into the cartridge. A staple can be refilled to an electric stapler (101) in a state of mounting the staple cartridge (103), and time and labor of attaching and detaching the staple cartridge is dispensed with.

3 Claims, 19 Drawing Sheets

FOREIGN PATENT DOCUMENTS

| | | |
|---|---|---|
| JP | 7-148674 | 6/1995 |
| JP | 7-115308 | 12/1995 |
| JP | 8-112782 | 5/1996 |
| JP | 10-180712 | 7/1998 |
| JP | 11-147204 | 6/1999 |
| JP | 11-157743 | 6/1999 |
| JP | 2001-105344 A | 4/2001 |
| JP | 2001-105345 | 4/2001 |
| JP | 2001-105346 | 4/2001 |
| JP | 2001-124032 | 5/2001 |
| JP | 2001-191266 | 7/2001 |
| JP | 2002-66952 A | 3/2002 |

STAPLE CARTRIDGE

This is a continuation application of copending application Ser. No. 10/495,551 filed on May 14, 2004, which is hereby incorporated by reference.

TECHNICAL FIELD

The present invention relates to a staple cartridge used in an electric stapler. Particularly, the invention relates to a staple cartridge promoting operability in refilling staples, a staple cartridge and a staple guide and a staple feed claw of the staple cartridge facilitating to deal with jamming.

BACKGROUND ART

There is known an electric stapler using a staple cartridge containing a linear staple. Staple sheets adhered with linear staples in parallel with each other are stacked to contain in a staple cartridge. The linear staple is formed to U-shape by a forming plate of an electric stapler and injected by a driver.

In a conventional art, when staples at inside of the staple cartridge have been consumed up, a whole of the staple cartridge is replaced, generally. However, a staple cartridge capable of refilling staple sheets has been spread, in order to achieve saving of resources and a reduction in wastes. A staple cartridge of this kind is formed to be able to refill staple sheets provided for refilling, by opening an upper cover or a lower face cover of a staple containing portion. However, when the staples are refilled to the staple cartridge, there is taken time and labor of removing the staple cartridge from the electric stapler and opening a cover of the staple cartridge and after charging the staple sheets thereto, closing the cover and setting the staples to the electric stapler and there poses a problem that the operation is devoid of swiftness.

Further, the staple cartridge for the electric stapler of the background art is formed to inject staples by passing a driver of the electric stapler through a clearance between a face plate attached to a front portion of the staple cartridge and a staple guide provided at a front end face of a staple cartridge main body. Therefore, when the staple is buckled to clog at inside of a path of the driver, there is needed a processing procedure of firstly removing an outer cabinet of the electric stapler, or when the electric stapler is included in a copier, opening a cover of the copier, removing the staple cartridge from the electric stapler, opening the front end face of the staple cartridge main body by pivoting or sliding the face plate attached to the staple cartridge and thereafter, removing the staple locked at inside of the driver path, and time and labor is taken for recovery thereof.

Further, there is a copier including the electric staplers for simultaneously binding a plurality of locations of paper by a plurality of the electric staplers and there is a copier successively binding a plurality of locations of paper by moving a single piece of the electric stapler by a feed mechanism. In the case of a copier constituted to dispose a copy face of paper on a lower side to stack on a sheet table for convenience of collation, in order to penetrate the staple into a bunch of paper to be stapled, a driver unit of the electric stapler is arranged on the lower side of the sheet table and a clincher unit is arranged on an upper side of the sheet table. A staple guide of the driver unit is brought into contact with a paper face by being brought into a hole formed at the sheet table on the lower side, the clincher unit on the upper side is moved down to pinch paper on the sheet table along with the staple guide and a leg portion of the staple penetrating paper from the lower side is folded by the clincher.

In this way, in order to pinch paper on the sheet table by the staple guide and the clincher unit of the driver unit, there is constructed a constitution of advancing the staple guide into the hole of the sheet table, forming a long hole in a lateral direction of the sheet table in the case of a copier of laterally moving a single piece of the electric stapler by the feed mechanism and moving the staple guide of the driver unit at inside of the long hole. Therefore, when paper is fed to the sheet table after having been processed by a copying step, there is a case of bringing about a failure in feeding paper by catching a front edge portion of paper by the long hole of the sheet table. Further, by using the long hole at the sheet table, bending strength of the sheet table is reduced and therefore, it is preferable to reduce a dimension of the hole as small as possible.

DISCLOSURE OF THE INVENTION

Hence, with regard to the above-described technical problem to be resolved, it is a first object of the invention to be able to easily and swiftly carrying out operation of refilling a staple to a staple cartridge.

Further, it is a second object of the invention to be able to simply removing a staple clogged at a driver path.

Further, it is a third object thereof to be able to move an electric stapler without forming a long hole at a sheet table.

The invention is proposed in order to achieve the above-described object and provides a staple cartridge constituted to be a staple cartridge attachable and detachable to and from a cartridge containing chamber of an electric stapler and a staple cartridge formed to be capable of charging a staple pack laminating to contain staple sheets adhered with linear staples in parallel with each other, wherein an opening portion is formed at a side face of the staple containing chamber of the staple cartridge, the opening portion is provided with an openable and closable door and a staple pack is made to be chargeable by opening the door in a state of charging the staple cartridge to the cartridge containing chamber of the electric stapler.

Further, the invention provides the staple cartridge, wherein the opening is arranged in a direction the same as a direction of an opening portion of the cartridge containing portion of the electric stapler in the state of charging the staple cartridge to the cartridge containing portion of the electric stapler.

Further, the invention provides the staple cartridge, wherein the door is a slide door slidable in an up and down direction and the slide door is urged to a closing position by a spring.

Further, the invention provides the staple cartridge constituted such that a door is a slide door slidable in an up and down direction, an end portion of a pressing plate brought into elastic contact with a staple sheet is projected to a path of moving the slide door in the staple cartridge and when the slide door is opened, the slide door is engaged with the pressing plate and the pressing palate is escaped from the opening portion.

Further, in order to achieve the above-described object, the invention provides a staple cartridge constituted to be a cartridge attachable and detachable to and from a cartridge containing chamber of an electric stapler and a staple cartridge formed to be able to charge a staple pack laminated to contain staple sheets adhered with linear staples in parallel with each other, comprising a staple guide for guiding a driver of the electric stapler at a face of a feeding outlet side of the staple sheet, wherein a driver path is constituted by opposing the staple guide to a face plate arranged at inside of the cartridge containing chamber of the electric stapler.

Further, the invention provides the staple cartridge arranged with a magnet at a vicinity of the staple guide of the staple cartridge and formed such that the staple at inside of the driver path is adsorbed to the magnet.

Further, in order to achieve the above-described object, the invention provides a staple cartridge constituted to be a staple cartridge used for an electric stapler provided with a staple guide capable of being projected in a direction of injecting a staple from inside of the staple cartridge at a front end portion of the staple cartridge, a drive mechanism of the electric stapler and a cooperatively moving mechanism for cooperatibly moving the staple guide, wherein in a stapling operation, the staple guide is projected in the direction of injecting the staple from inside of the staple cartridge and in finishing the stapling operation, the staple guide is escaped to inside of the staple cartridge.

Further, the invention provides a staple cartridge wherein the cooperatively moving mechanism is constituted by the staple guide attached to the staple cartridge via a leaf spring and a slider moved to reciprocate in a front and rear direction by a mechanism of driving the electric stapler and when the slider is moved forward, the staple guide is projected in the direction of injecting the staple from inside of the staple cartridge by pushing the leaf spring disposed in a moving path of the slider.

Further, the invention provides the staple cartridge constituted such that a feed claw is attached to the slider via a leaf spring and the feed claw is engaged with the staple sheet or moved to slide on the staple sheet in accordance with a feed load.

Figure 1:
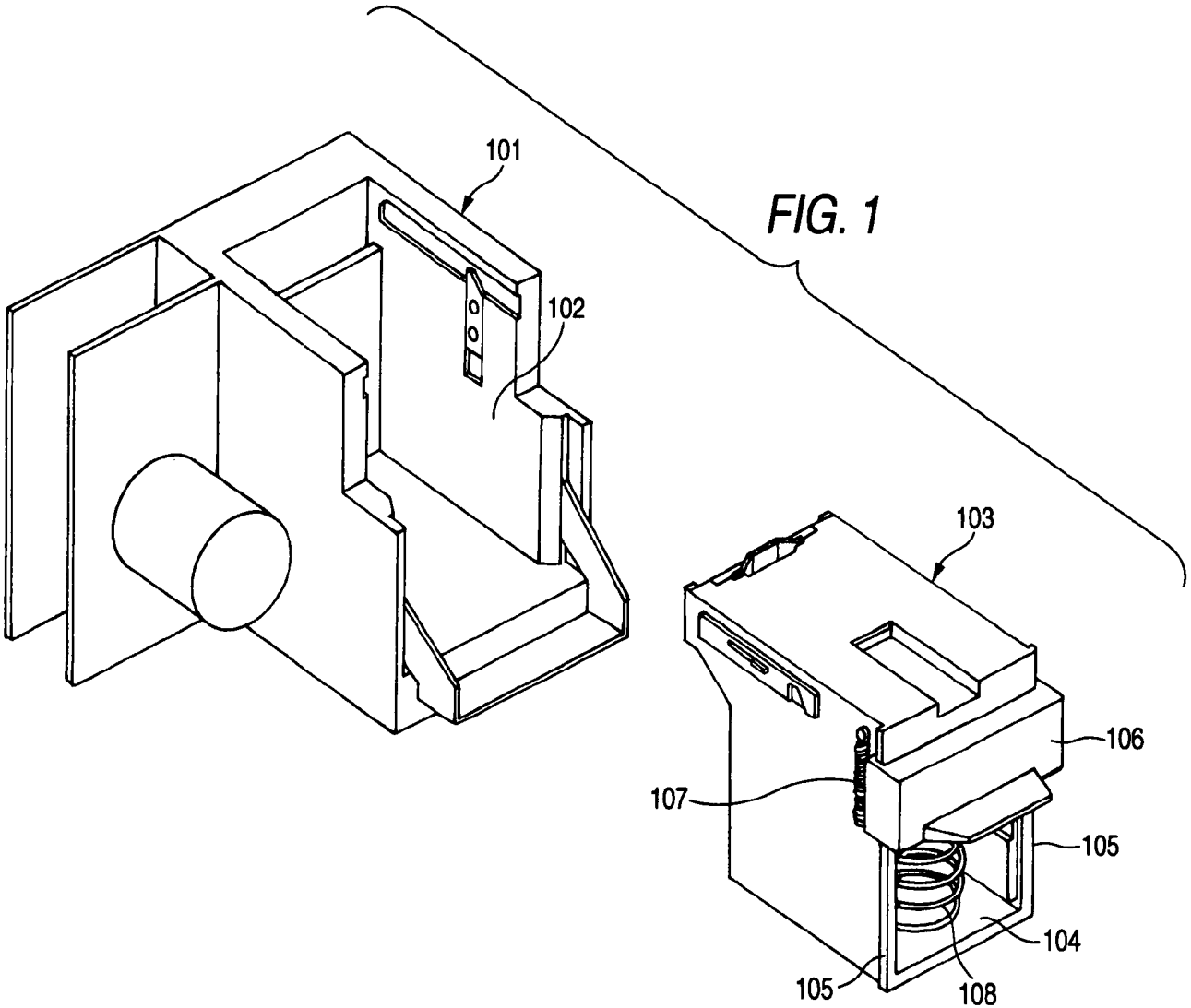
FIG. 1 is a perspective view of a staple cartridge and an electric stapler showing an embodiment of the invention.

Further, in notations of the drawing, numeral 103 designates a staple cartridge, numeral 104 designates an opening portion, numeral 105 designates a guide rail portion, numeral 106 designates a slide door, numeral 107 designates a tension coil spring, numeral 108 designates a compression coil spring, numeral 109 designates a pressing plate, numeral 121 designates a staple pack, numeral 122 designates a staple sheet, numeral 201 designates a driver unit, notation 201*a* designates a driver, numeral 203 designates a staple cartridge, numeral 204 designates an opening portion, numeral 205 designates a guide rail portion, numeral 206 designates a slide door, numeral 207 designates a tension coil spring, numeral 208 designates a compression coil spring, numeral 209 designates a pressing plate, numeral 211 designates a leaf spring, numeral 212 designates a staple guide, numeral 213 designates a face plate, numeral 214 designates a slider, numeral 215 designates a leaf spring, numeral 216 designates a feed claw, numeral 222 designates a guide table, numeral 223 designates a magnet, numeral 224 designates a front face cover, numeral 303 designates a staple cartridge, numeral 304 designates an opening portion, numeral 305 designates a guide rail portion, numeral 306 designates a slide door, numeral 307 designates a tension coil spring, numeral 308 designates a compression coil spring, numeral 309 designates a pressure plate, numeral 311 designates a leaf spring, numeral 312 designates a staple guide, numeral 313 designates a slider, numeral 314 designates a leaf spring, numeral 315 designates a feed claw, numeral 316 designates an arm, numeral 317 designates a groove, numeral 341 designates a sheet table, and numeral 342 designates a hole.

DESCRIPTION OF THE PREFERRED EMBODIMENTS

Figure 2:
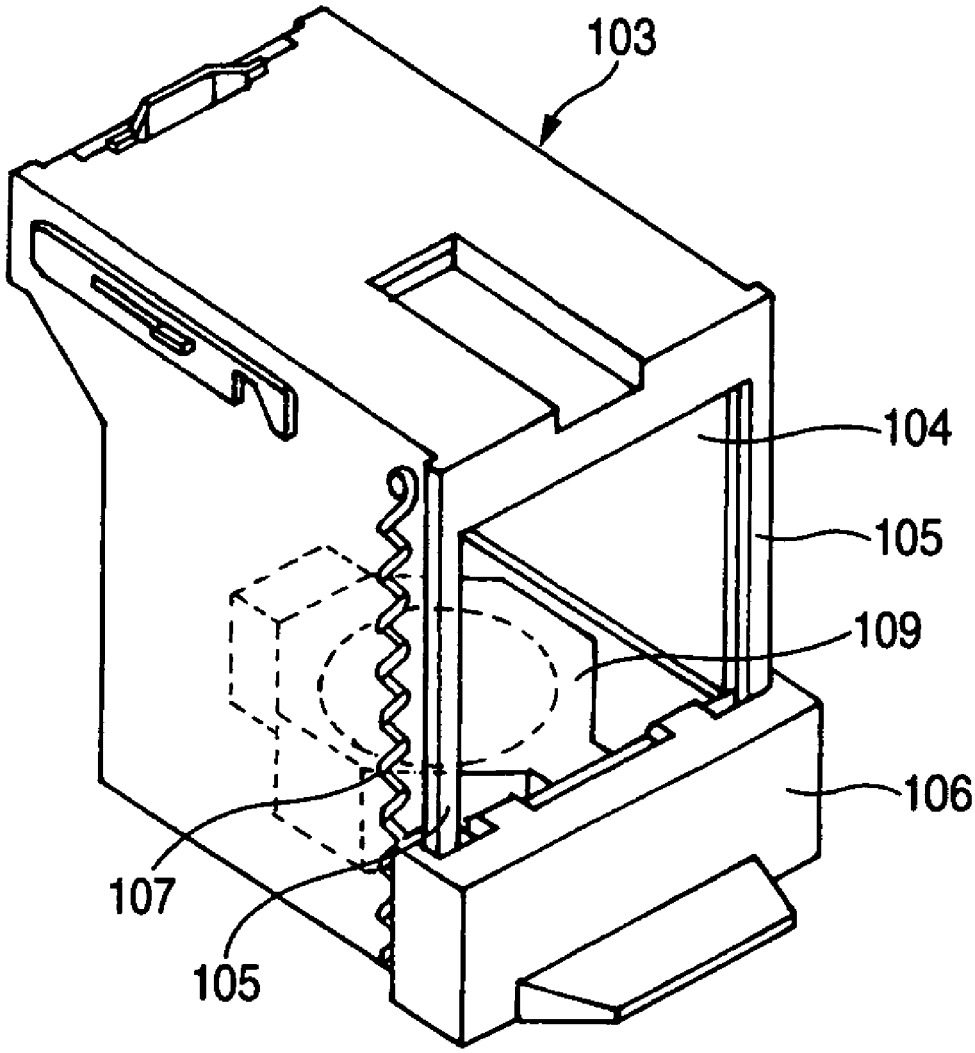
FIG. 2 is a perspective view showing the staple cartridge in a state of opening a slide door.

A detailed description will be given of a first embodiment of the invention in reference to FIG. 1 through FIG. 4 as follows. In FIG. 1, numeral 101 designates a driver unit of an electric stapler which is arranged at inside of a copier (not illustrated) in an attitude reversing a normal attitude in an up and down direction in view of a relationship with a print face of the copier and injects a staple from the driver unit 101 to a clincher unit (not illustrated) on an upper side. The staple cartridge 103 attachable and detachable to and from a cartridge containing portion 102 of the driver unit 101 is formed with the opening portion 104 at a rear face thereof and the slide door 106 is engaged with the guide rail portion 105 in a vertical direction formed at rear ends of two left and right side faces thereof. The slide door 106 is pulled up to an upper side by the tension coil spring 107 made to span upper portions of the two left and right side faces of the staple cartridge 103 and the slide door 106. Further, inside of the staple cartridge 103 includes a pressing plate, mentioned later, the pressing plate is pushed up to the upper side by the compression coil spring 108 installed at an inner bottom face thereof. A groove (not illustrated) is formed at a lower end portion of a center of a front face face on a side of inside of a cartridge) of the slide door 106, a rear end portion of the pressing plate is projected to a position of the groove and when the slide door 106 is pushed down to a lower side as shown by FIG. 2, the rear end portion of the pressing plate 109 is engaged with the groove and also the pressing plate 109 is moved down simultaneously as shown by the drawing.

Figure 3:
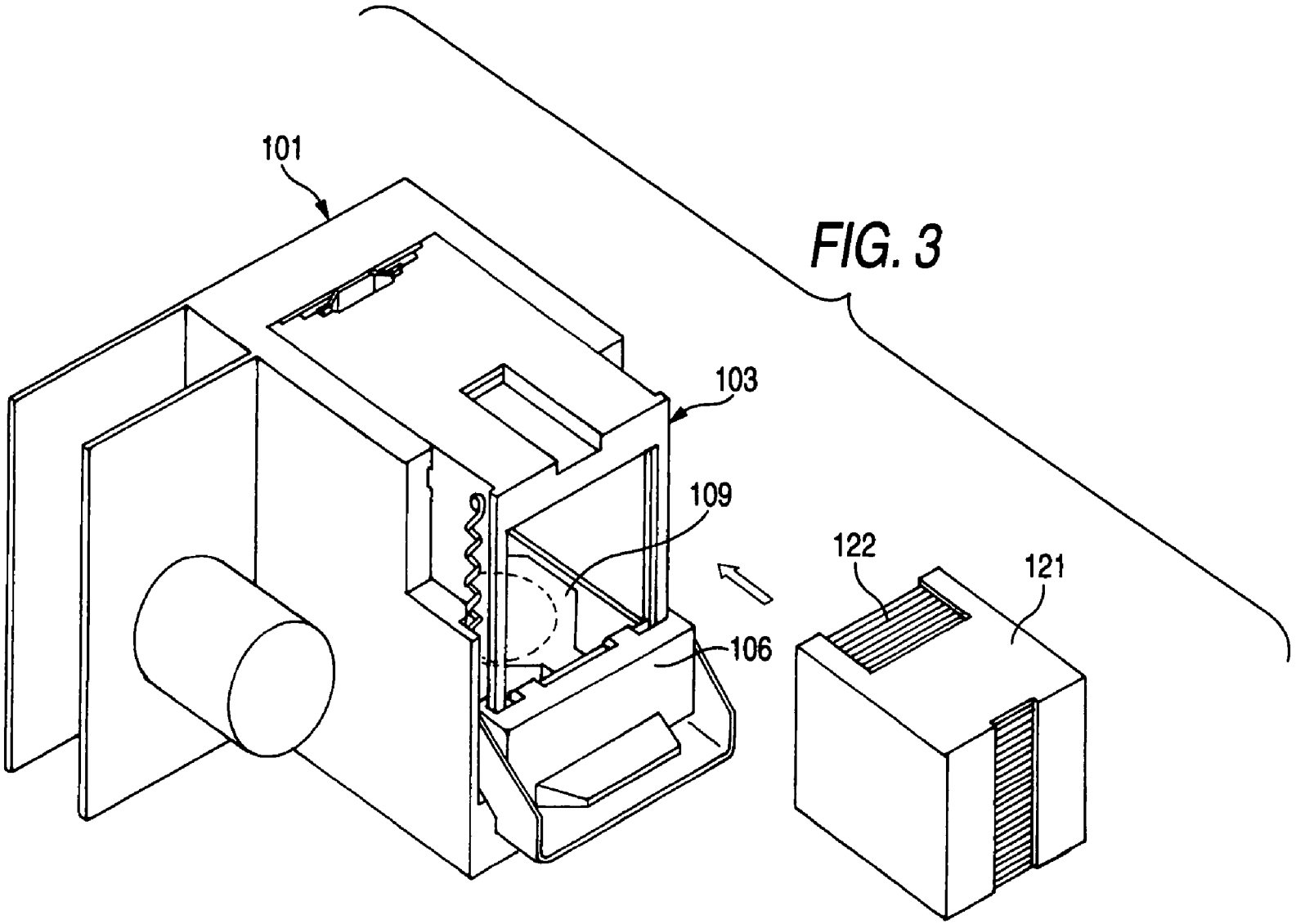
FIG. 3 is a perspective view of a state of mounting the staple cartridge to the electric stapler.

FIG. 3 shows a state of mounting the staple cartridge 103 to the driver unit 101 of the electric stapler, numeral 121 designates the staple pack made of paper for refilling, and a predetermined number of sheets of the staple sheets 122 are stacked to be contained in the staple pack 121. In the drawing, the staple pack 121 is formed with windows at a lower face, a front portion of an upper face thereof and a rear face thereof. The pressing plate 109 is brought into the window of the lower face and is brought into contact with a lower face of the staple sheet 122. A feed claw disposed at inside of the staple cartridge 103 is brought into contact with a front portion of an upper face of the staple sheet 122.

Figure 4:
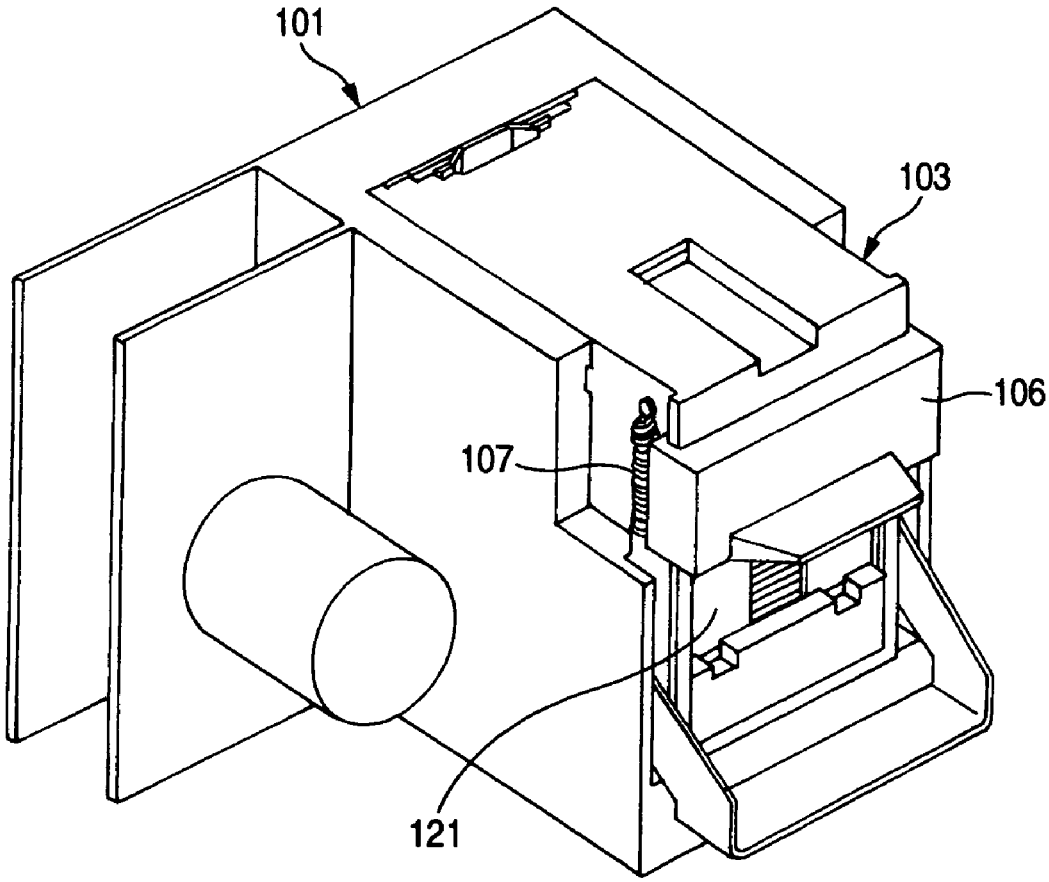
FIG. 4 is a perspective view showing a state of charging a staple to the staple cartridge.

In charging the staple pack 121 to the staple cartridge 103 without removing the staple cartridge 103 from the electric stapler, as shown by FIG. 3, the slide door 106 and the pressing plate 109 are pushed down to the lower side and the staple pack 121 is inserted from a rear side of the staple cartridge 103 into a staple pack containing chamber. When the slide door 106 is released from being pushed down after inserting the staple pack 121, as shown by FIG. 4, the slide door 106 is moved up to an initial position by being drawn by an elastic force of the tension coil spring 107 and a rear face of the staple pack 121 is covered. The pressing plate 109 is brought into elastic contact with the lower face of the staple sheet 122 at inside of the staple pack 121 to press to a ceiling face at inside of the staple cartridge 103 and the pressing plate 109 is moved up in accordance with a reduction in a number of sheets of the staple sheets 122. In the case of using up the staples, when the slide door 106 is pushed down against an elastic force of the tension coil spring 107, the empty staple pack 121 is drawn out and a new staple pack is charged thereto, the staple cartridge can immediately be used and staples are simply refilled by dispensing with time and labor of attaching and detaching the staple cartridge.

Figure 5:
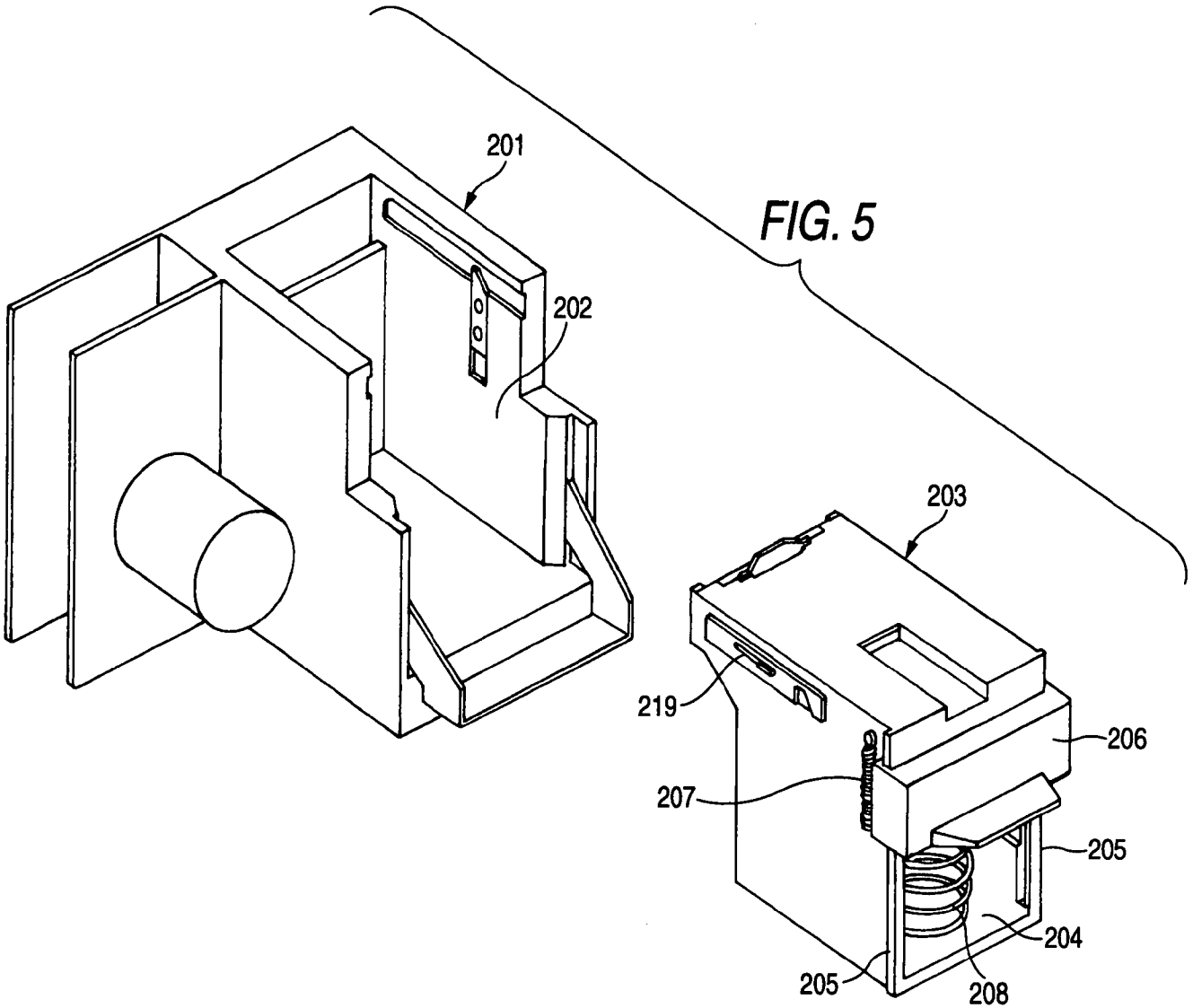
FIG. 5 is a perspective view of the staple cartridge and the electric stapler showing an embodiment of the invention.
Figure 6:
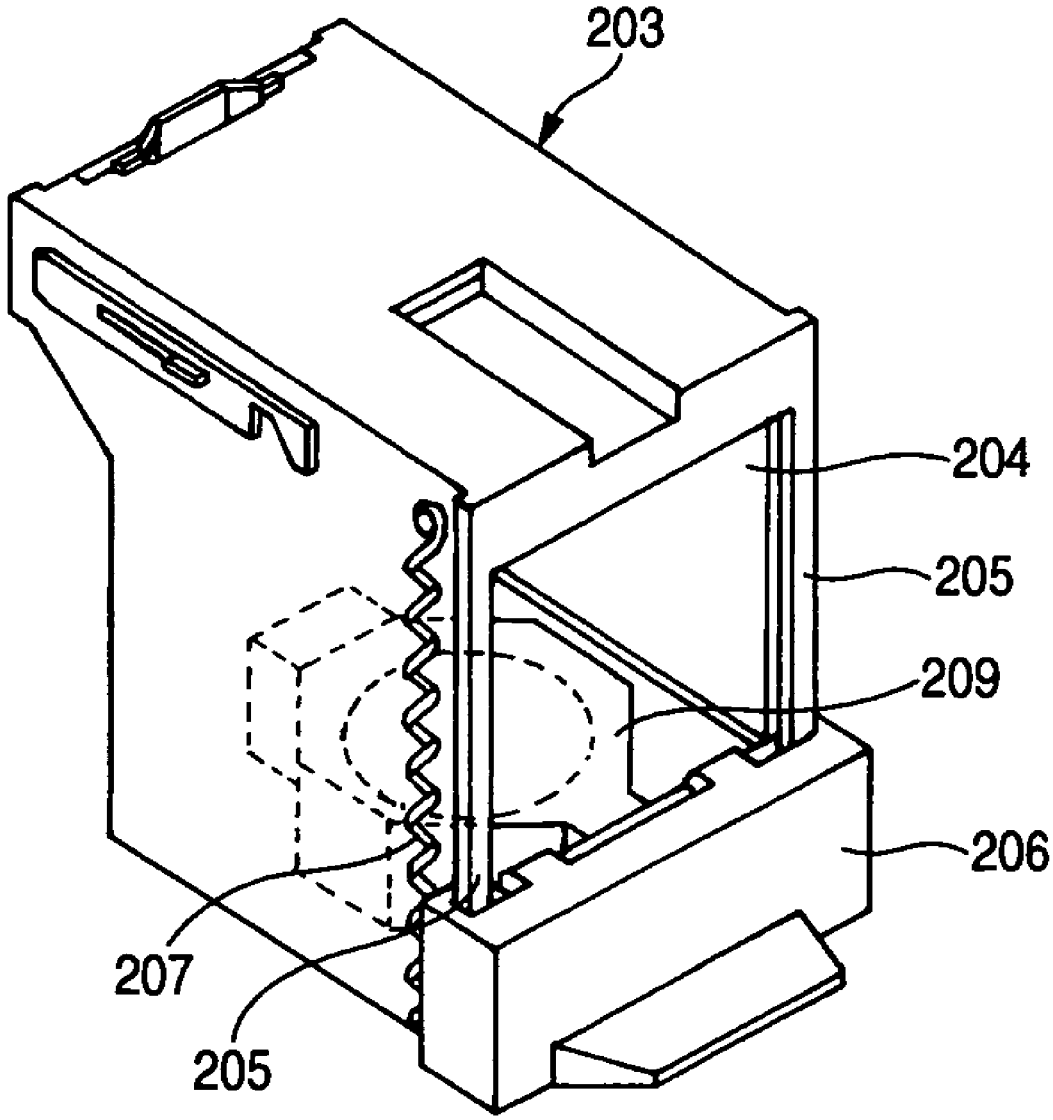
FIG. 6 is a perspective view showing the staple cartridge in a state of opening the slide door.

Next, a detailed description will be given of a second embodiment of the invention in reference to FIG. 5 through FIG. 10. In FIG. 5, numeral 201 designates the driver unit of the electric stapler which is arranged at inside of a copier (not illustrated) in an attitude reversing a normal attitude in an up and down direction in view of a relationship with a print face of the copier and injects a staple from the driver unit 201 to a clincher unit (not illustrated) arranged opposedly thereto on an upper side thereof. The staple cartridge 203 attachable and detachable to and from a cartridge containing portion 202 of the driver unit 201 is formed with the opening portion 204 at a rear face thereof and the slide door 206 is engaged with the guide rail portion 205 in a vertical direction formed at rear ends of two left and right side faces. The slide door 206 is pulled out to the upper side by the tension coil spring 207 made to span upper portions of the two left and right side faces of the staple cartridge 203 and the slide door 206. Further, inside of the staple cartridge 203 includes a pressing plate, not illustrated, and the pressing plate is pushed up to the upper side by the compression coil spring 208 installed at an inner bottom face thereof. The slide door 206 is formed with a groove (not illustrated) at a lower end portion of a center of a front face (face on a side of inside of a cartridge), a rear end portion of the pressing plate is projected to a position of the groove and when the slide door 206 is pushed down to a lower side as shown by FIG. 6, the rear end portion of the pressing plate 209 is engaged with the groove and also the pressing plate 209 is moved down simultaneously as shown by the drawing.

Figure 7:
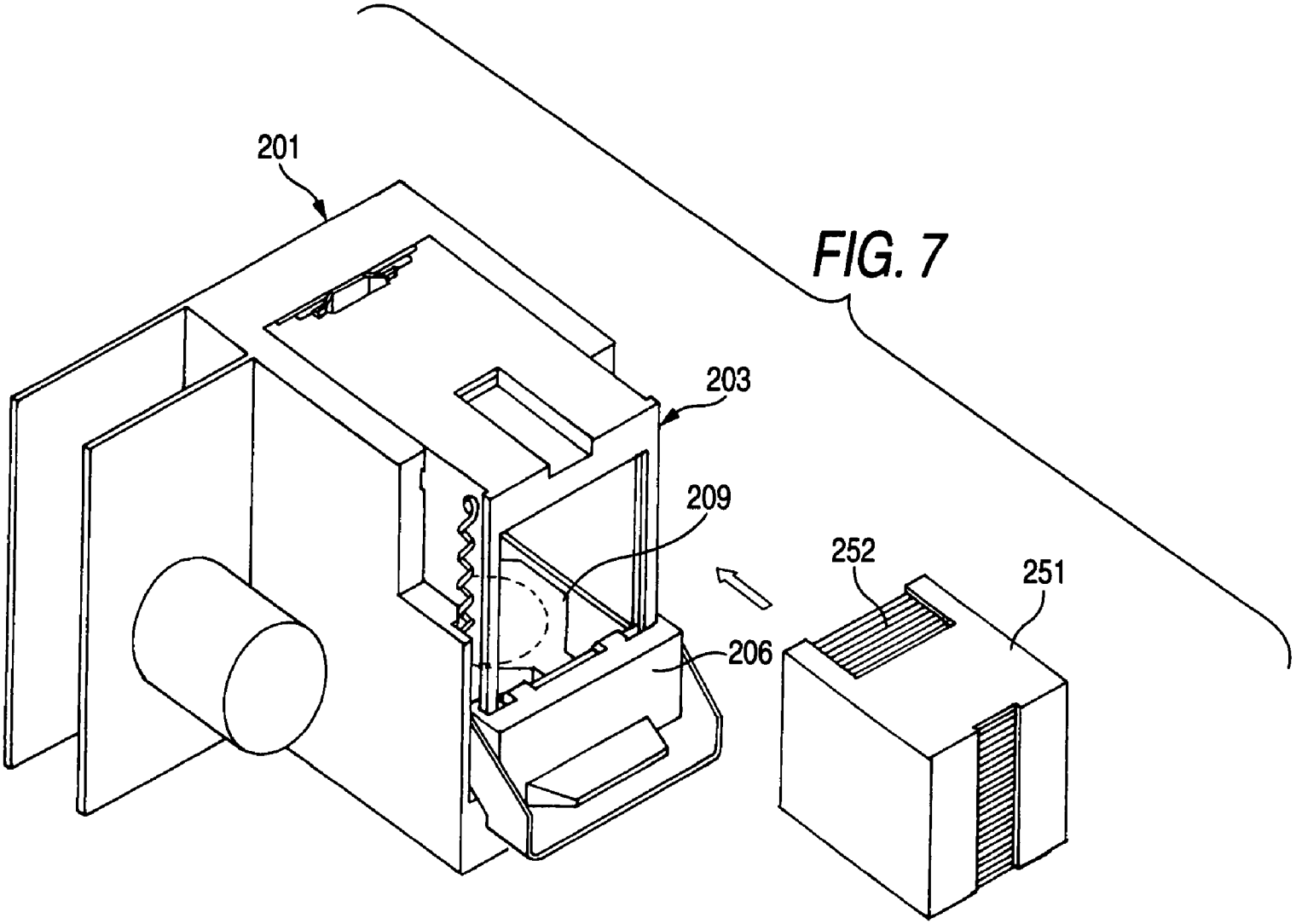
FIG. 7 is a perspective view of a state of mounting the staple cartridge to the electric stapler.

FIG. 7 shows a state of mounting the staple cartridge 203 to the driver unit 201 of the electric stapler, numeral 251 designates a staple pack made of paper for refilling, and a predetermined number of sheets of staple sheets 252 are stacked to be contained to the staple pack 251. The staple pack 251 is formed with windows at a lower face thereof, a front portion of an upper face thereof and a rear face thereof. The pressing plate 209 is brought into the window of the lower face to be brought into contact with a lower face of a staple sheet 252. A feed claw disposed at inside of the staple cartridge 203 is brought into contact with a front portion of an upper face of the staple sheet 252.

Figure 8:
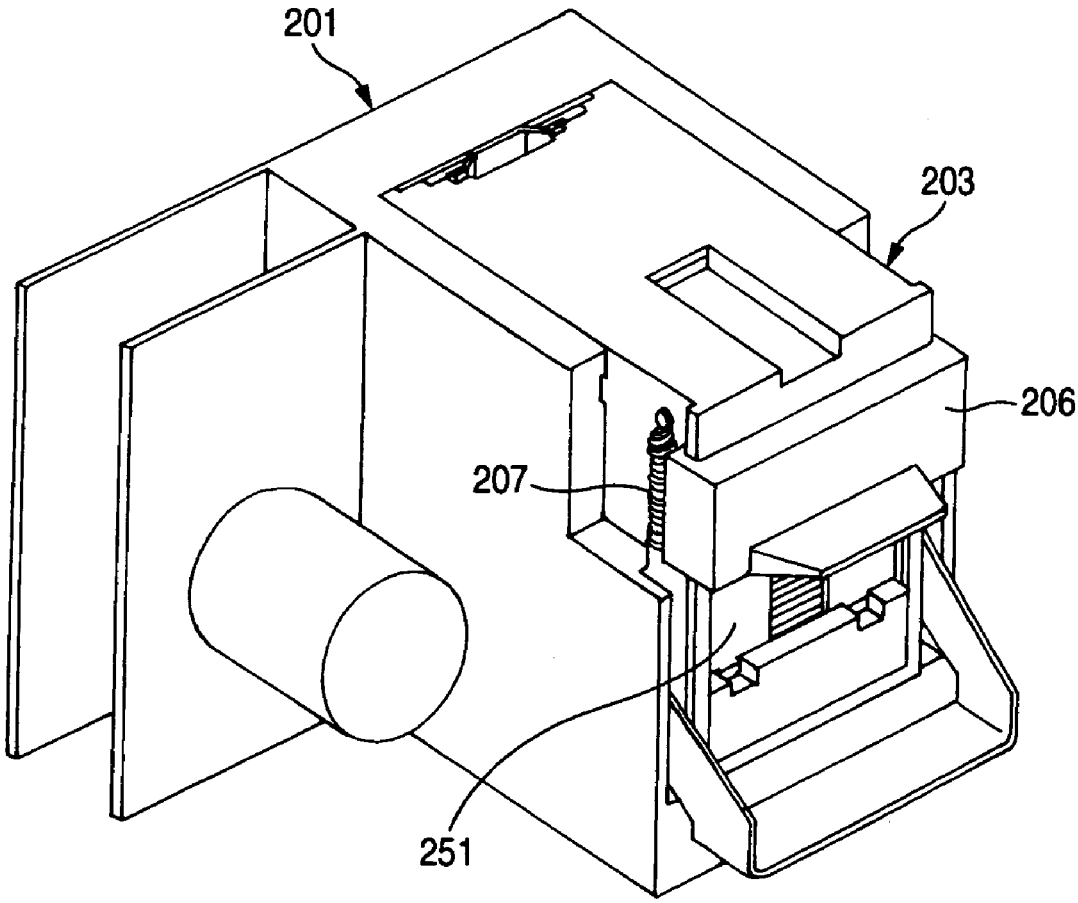
FIG. 8 is a perspective view showing a state of charging a staple to the staple cartridge.

In charging the staple pack 251 to the staple cartridge 203, as shown by FIG. 7, the slide door 206 and the pressing plate 209 are pushed down to the lower side, and the staple pack 251 is inserted into the staple cartridge 203 from a rear side of the staple cartridge 203. When the slide door 206 is released from being pushed down after inserting the staple pack 251, as shown by FIG. 8, the slide door 206 is moved up to an initial position by being drawn by the tension coil spring 207 and a rear face of the staple pack 251 is covered. The pressing plate 209 is brought into elastic contact with a lower face of the staple sheet 252 at inside of the staple pack 251 to press to a ceiling face at inside of the staple cartridge 203 and the pressing plate 209 is moved up in accordance with a reduction in a number of sheets of the staple sheets 252. When the staples have been used up, the empty staple pack 251 is drawn out by pushing down the slide door 206 and a new staple pack is charged thereto.

Figure 9:
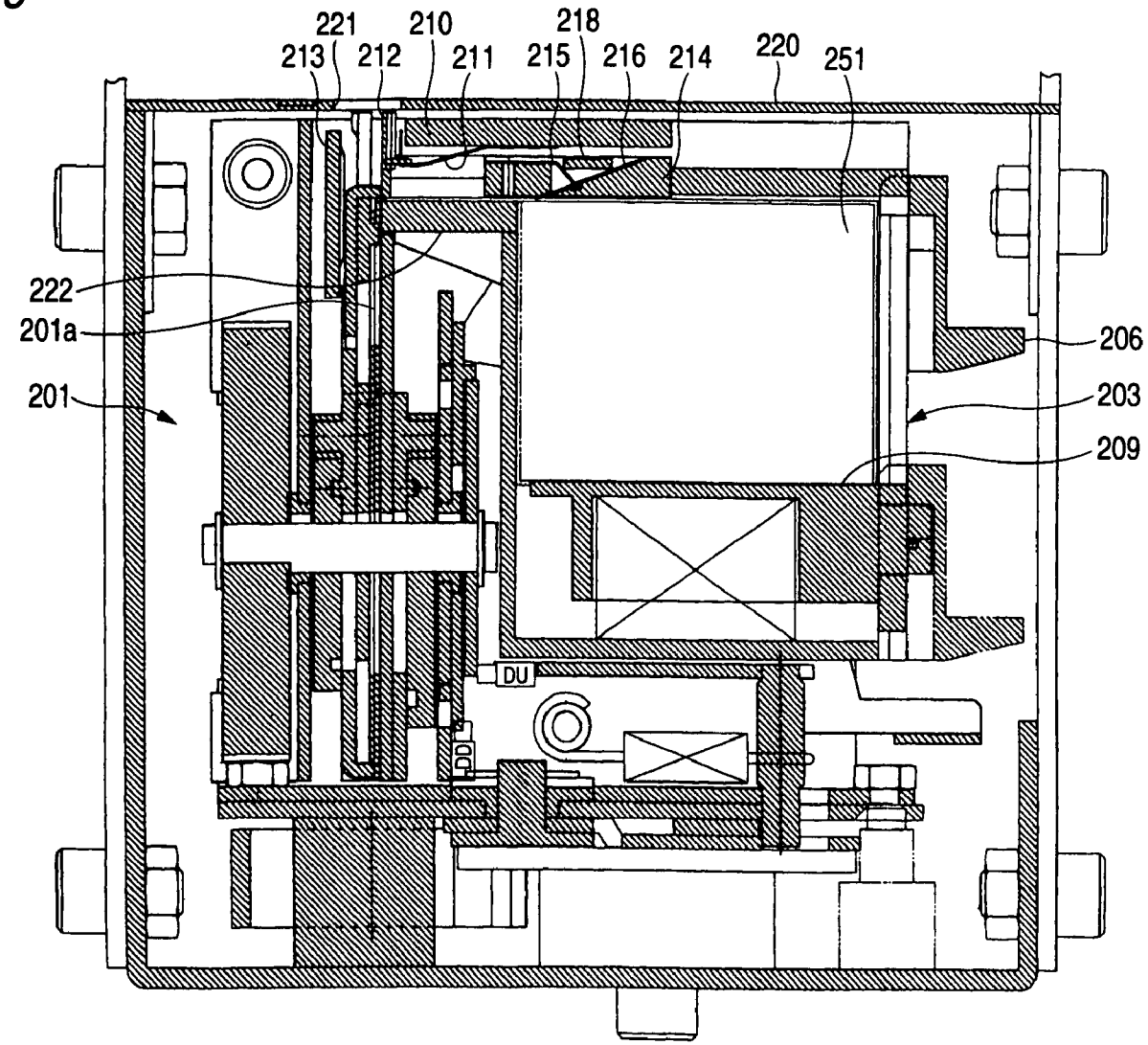
FIG. 9 is a side sectional view of a driver unit and the staple cartridge.

FIG. 9 shows a state of mounting the staple cartridge 203 to the driver unit 201 of the electric stapler. A lower face of a ceiling plate portion 210 of the staple cartridge 203 is attached with the leaf spring 211 in a front skewed lower direction and a front end of the leaf spring 211 is attached with the staple guide 212 constituting a guide of a rear face side (right on the drawing) of the driver of the electric stapler. The staple guide 212 is opposed to the face plate 213 provided at the driver unit 201 and an interval between the face plate 213 and the staple guide 212 which is a rear driver guide constitutes a path of the driver 201*a*. The slider 214 slidable in a front and rear direction is provided below the ceiling plate portion 210, a front portion of the slider 214 is attached with the leaf spring 215 in a rear skewed lower direction and the feed claw 216 is attached to a front end portion of the leaf spring 215.

Figure 10:
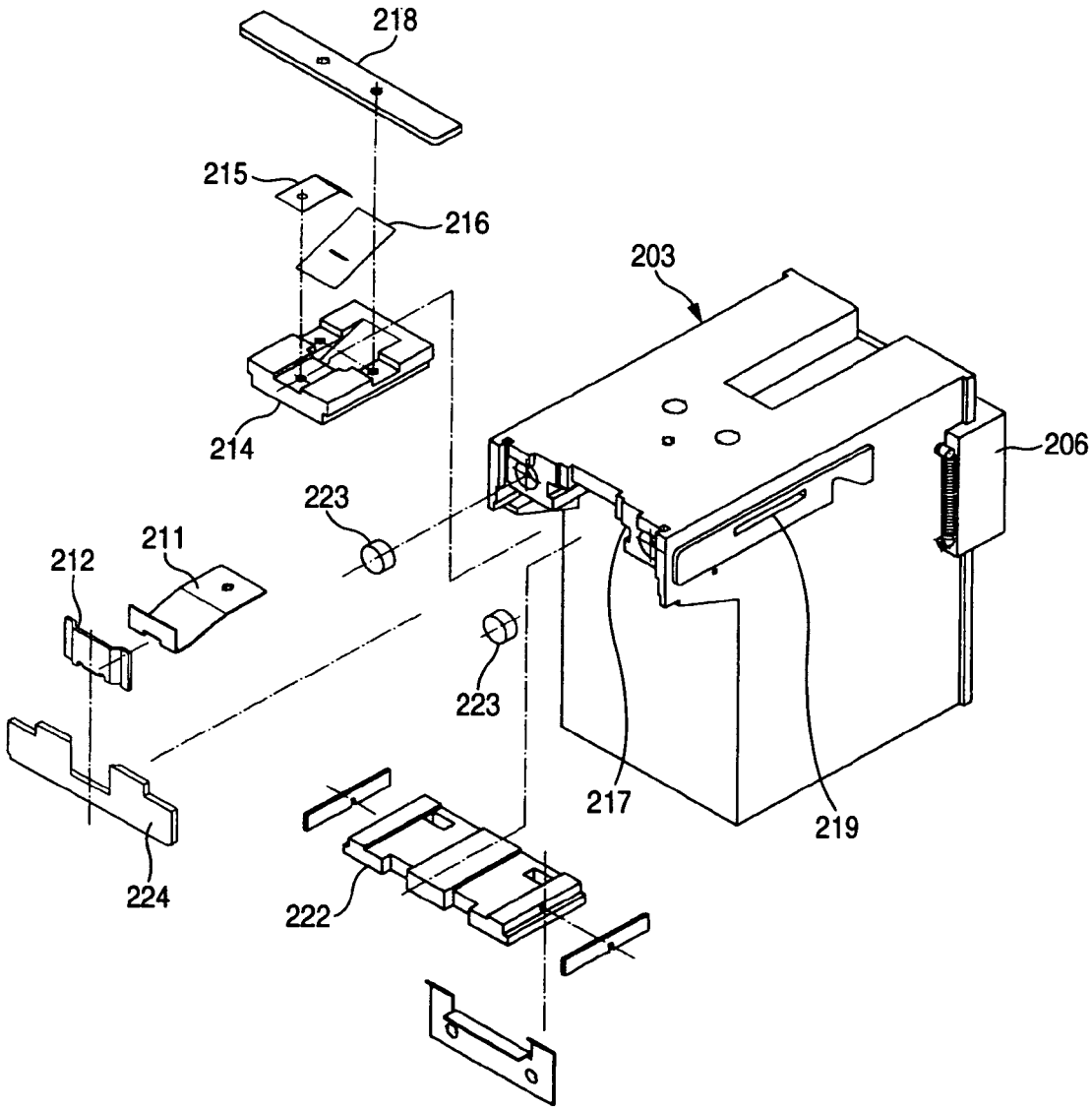
FIG. 10 is a view of assembling a staple cartridge.

The slider 214 is inserted into a slide guide groove 217 of the staple cartridge 203 shown in FIG. 10 and is attached with an arm 218 directed in a transverse direction at an upper face thereof. Two left and right ends of the arm 218 are projected to outer sides as shown by FIG. 5 via grooves 219 formed at two left and right side walls of the staple cartridge 203 and driven to reciprocate in the front and rear direction by a staple feed link lever (not illustrated) of the electric stapler to feed the staple sheet to the front side by the feed claw 215 provided at the slider 214. As shown by FIG. 9, a front portion of the leaf spring 211 attached with the staple guide 212 is moved down from an upper face of the slider 214 and when the slider 214 is moved forward, the slider 214 is brought into contact with a lower face of the leaf spring 211 to push up the leaf spring 211 and the staple guide 212 to an upper side and the staple guide 212 advances into a hole 221 of a sheet table 220.

Numeral 222 indicated in FIG. 9 and FIG. 10 designates the guide table for guiding the staple sheet which is fed out and the staple sheet is moved forward from an upper face of the guide table 222. As shown by FIG. 10, two pieces of the magnets 223 are embedded on left and right sides of a front end face of the staple cartridge 203 and a front face thereof is mounted with the front face cover 224 formed by a magnetic metal of iron or the like. The front face cover 224 is brought into contact with the magnets 223 and a magnetic field is generated at a surrounding of the front face cover 224 and the staple guide 212.

In the case in which the staple is buckled and clogged at inside of the driver path in using the electric stapler, when the staple cartridge 203 is removed from the driver unit 201, the buckled staple is taken out by being adsorbed to the front face cover 224 and the staple guide 212 and therefore, when the staple is removed and the staple cartridge 203 is mounted again to the driver unit 201, the electric stapler is recovered to a usable state and jamming can very simply be dealt with.

Figure 11:
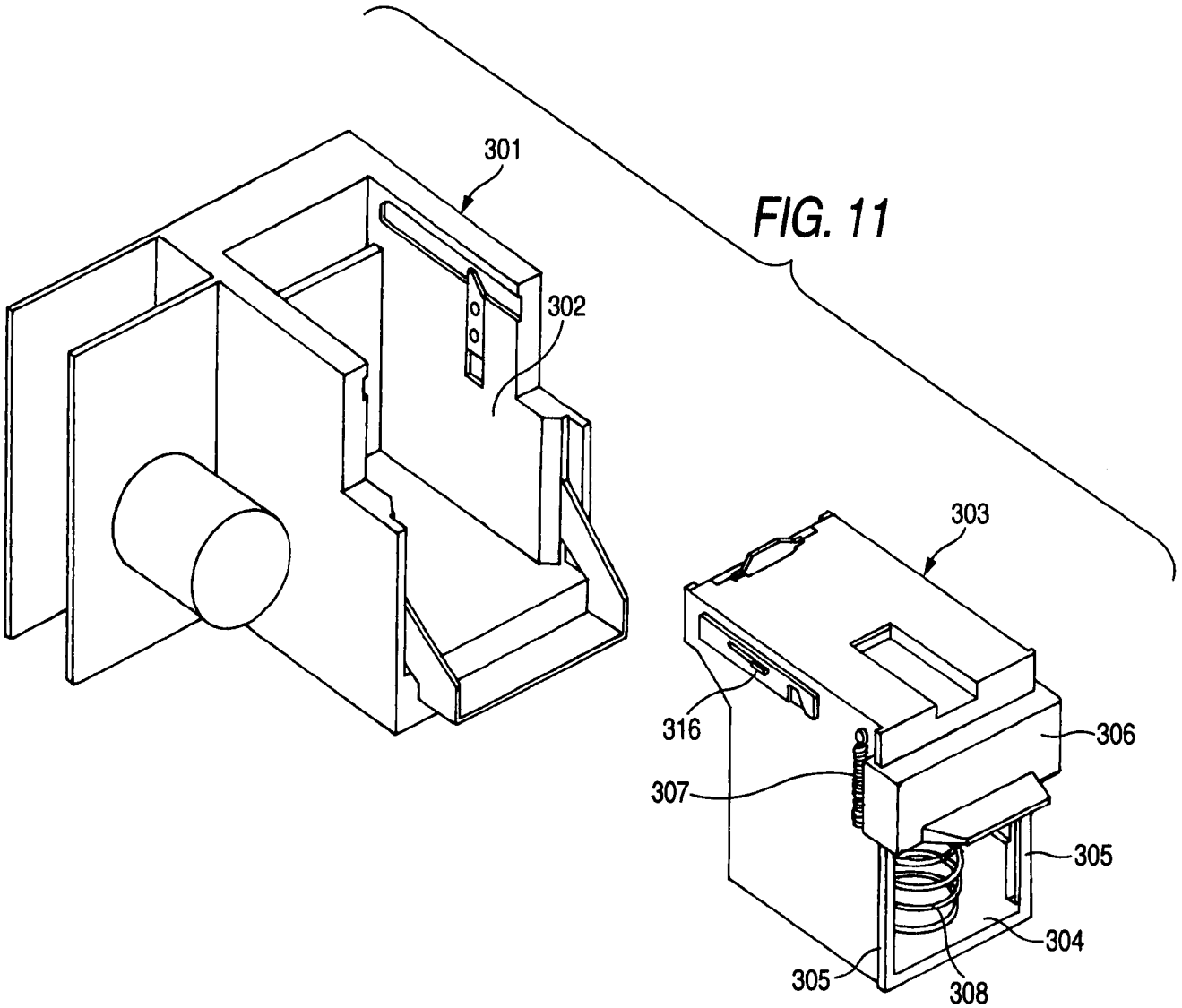
FIG. 11 is a perspective view of the staple cartridge and the electric stapler showing an embodiment of the invention.
Figure 12:
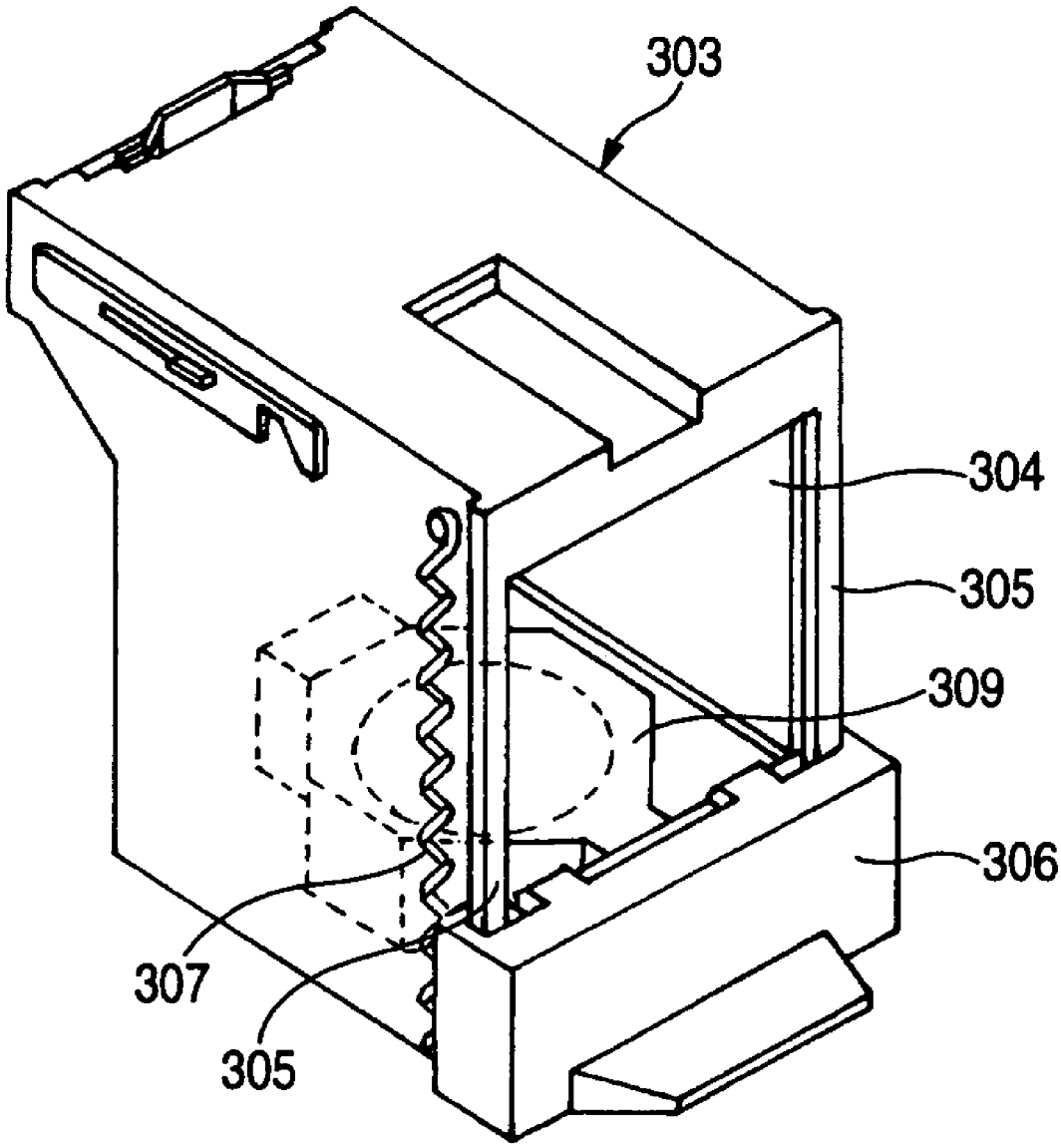
FIG. 12 is a perspective view of a state of opening a slide door showing a staple cartridge.

Next, a detail description will be given of a third embodiment of the invention in reference of FIG. 11 through FIG. 19. In FIG. 11, numeral 301 designates a driver unit of an electric stapler, the driver unit is arranged on a lower side of a sheet table (not illustrated) by being reversed from a normal attitude in an up and down direction in view of a relationship with a print face of a copier and a clincher unit (not illustrated) is arranged on an upper side of the sheet table. The staple cartridge 303 attachable and detachable to and from a cartridge containing portion 302 of the driver unit 301 is formed with the opening portion 304 at a rear face thereof and the slide door 306 is engaged with the guide rail portion 305 in a vertical direction formed at rear ends of two left and right side faces. The slide door 306 is pulled up to an upper side by the tension coil spring 307 made to span upper portions of the two left and right side faces of the staple cartridge 303 and the slide door 306. Further, inside of the staple cartridge 303 includes a pressure plate, mentioned later, and the pressure plate is pushed up to the upper side by the compression coil spring 308 installed at an inner bottom face thereof. The slide door 306 is formed with a groove (not illustrated) at a lower end portion of a center of a front face (face on a side of inside of a cartridge) thereof, a rear end portion of the pressure plate is projected to a position of the groove and when the slide door 306 is pushed down to a lower side as shown by FIG. 12, also the pressure plate 309 is moved down simultaneously as shown by the drawing.

Figure 13:
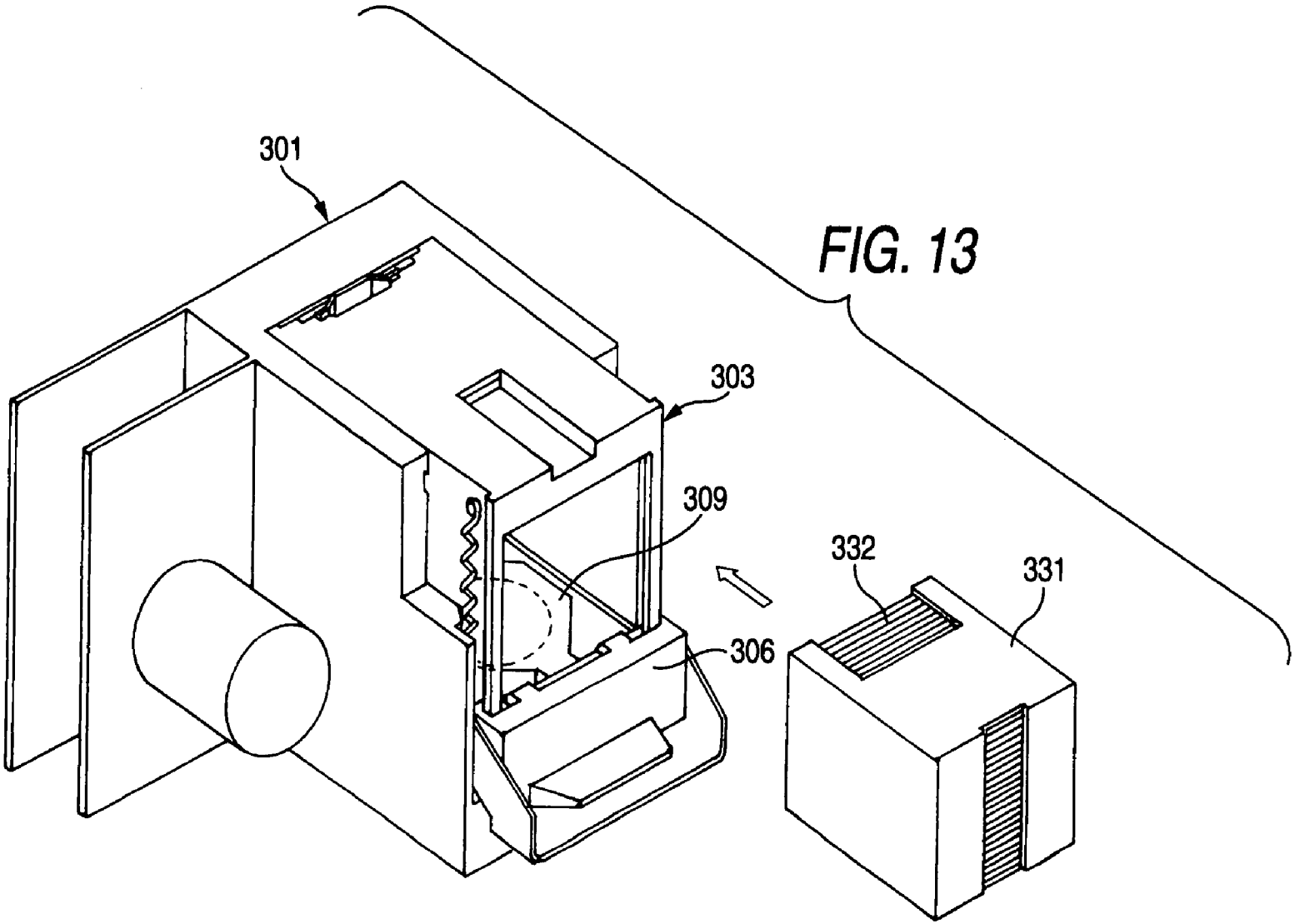
FIG. 13 is a perspective view of a state of mounting the staple cartridge to a driver unit of the electric stapler.
Figure 14:
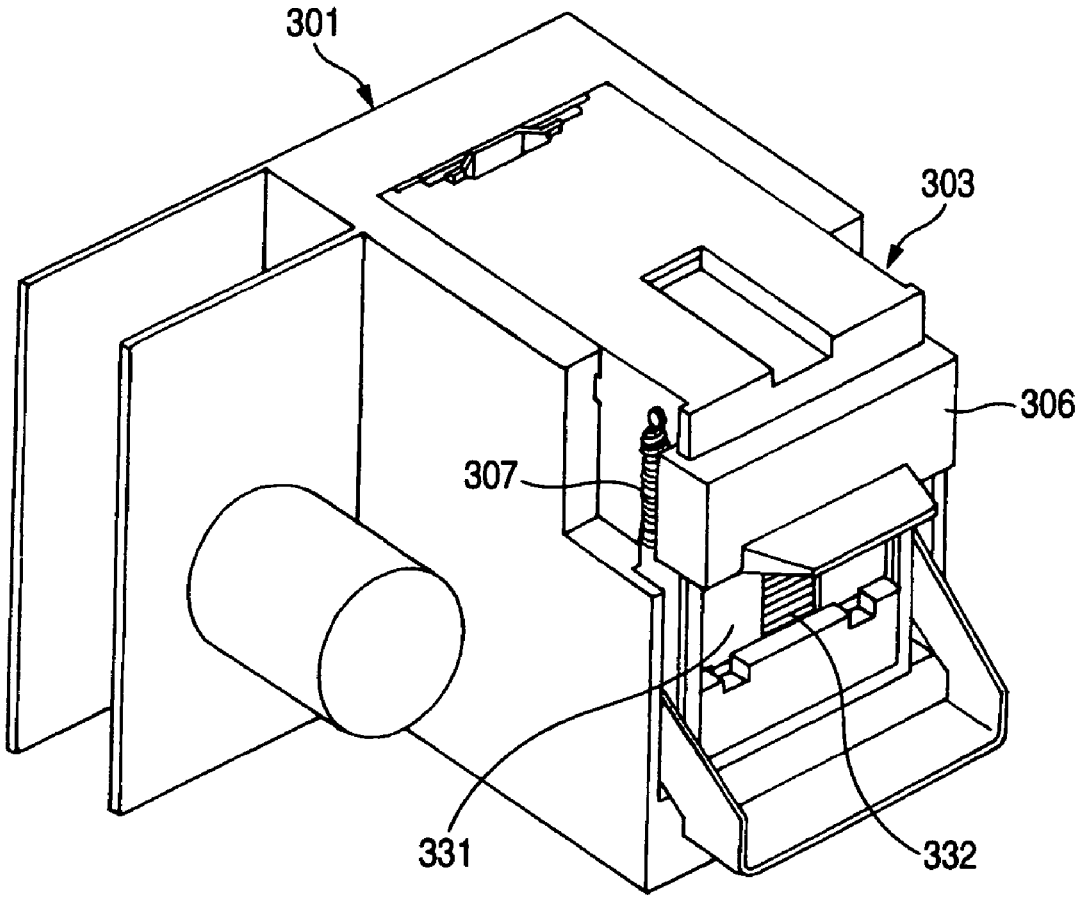
FIG. 14 is a perspective view showing a state of charging a staple to the staple cartridge.

FIG. 13 shows the staple cartridge 303 and a staple pack 331 made of paper for refilling, and a predetermined number of sheets of staple sheets 332 are stacked to be contained in the staple pack 331. In the drawing, the staple pack 331 is formed with windows at a lower face thereof, a front portion of an upper face thereof and a rear face thereof and as shown by FIG. 14, when the slide door 306 is released from being pushed down after inserting the staple pack 331 to the staple cartridge 303, the above-described pressure plate 309 is brought into the window at the lower face to press the staple sheet 332 to an upper side and a feed claw disposed at inside of the staple cartridge 303 is brought into contact with a front portion of an upper face of the staple sheet 332. The slide door 306 is moved up to an initial position by being urged by the tension coil spring 307 and a rear face of the staple pack 331 is covered.

Figure 15:
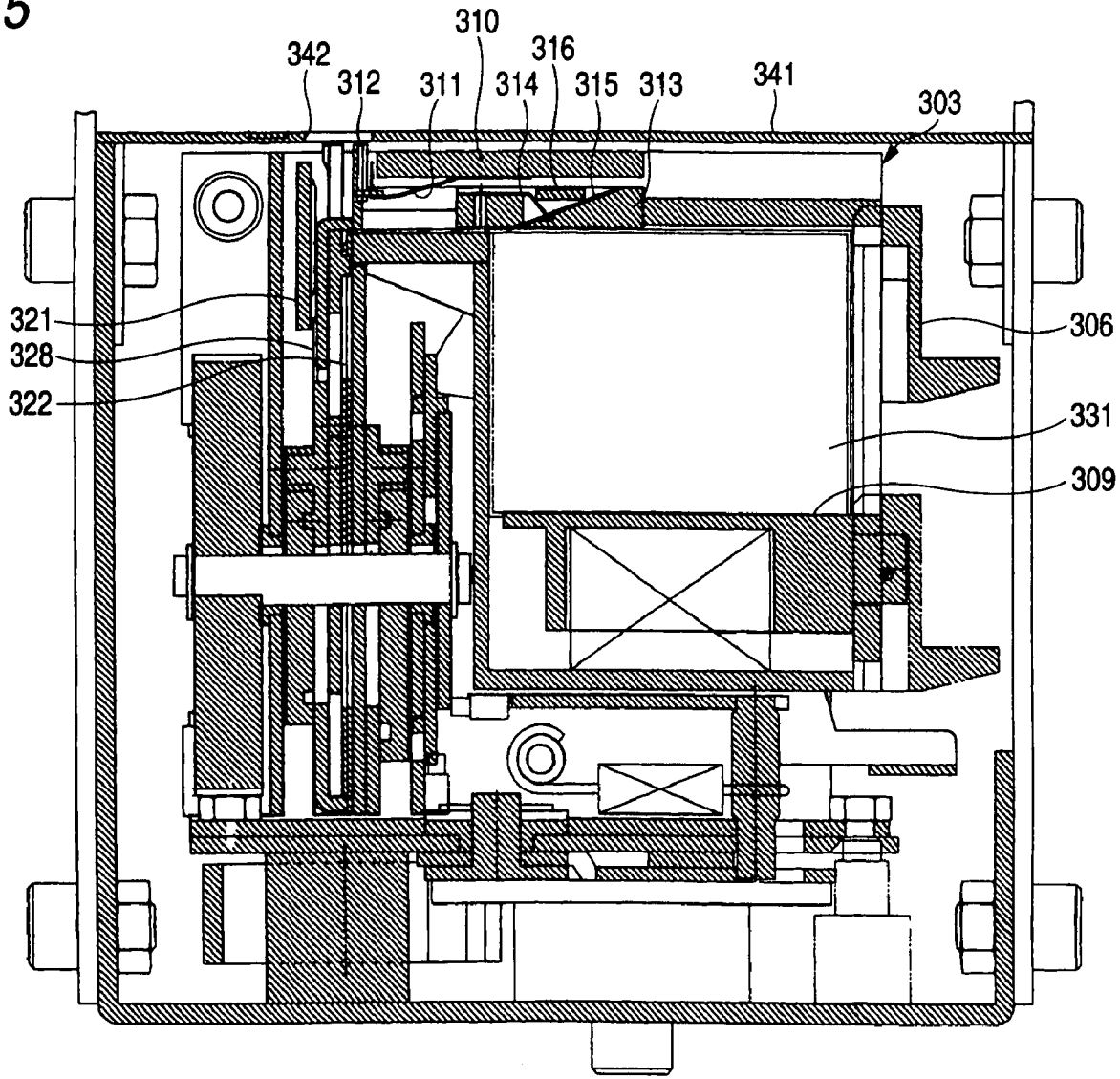
FIG. 15 is a side sectional view of a state of mounting the staple cartridge to a driver unit of the electric stapler.

FIG. 15 shows a state of mounting the staple cartridge 303 to the driver unit 301. According to the staple cartridge 303, the leaf spring 311 is attached to a lower face of a ceiling plate portion 310 in a front skewed lower direction and a front end of the leaf spring 311 is attached with the staple guide 312. An upper end of the staple guide 312 is disposed at a height substantially the same as that of an upper face of the staple cartridge 303 and in a state of mounting the staple cartridge 303 to the driver unit 301, the staple guide 312 is opposed to a face plate 321 on a front side provided at the driver unit 301 and the staple and a driver 322 pass a path at an interval between the face plate 321 and the staple guide 312.

The slider 313 slidable in the front and rear direction is provided below the ceiling plate portion 310 of the staple cartridge 303, the leaf spring 314 is attached to a front portion of the slider 313 in a rear skewed lower direction, and the feed claw 315 is attached to a front end portion of the leaf spring 314. Further, an upper face of the slider 313 is attached with the arm 316 extended in a transverse direction.

By combining members centering on the staple guide 312 and the slider 313, mentioned above, a drive mechanism of the electric stapler and a cooperatively moving mechanism for cooperatively moving the staple guide 312 are constituted.

Figure 16:
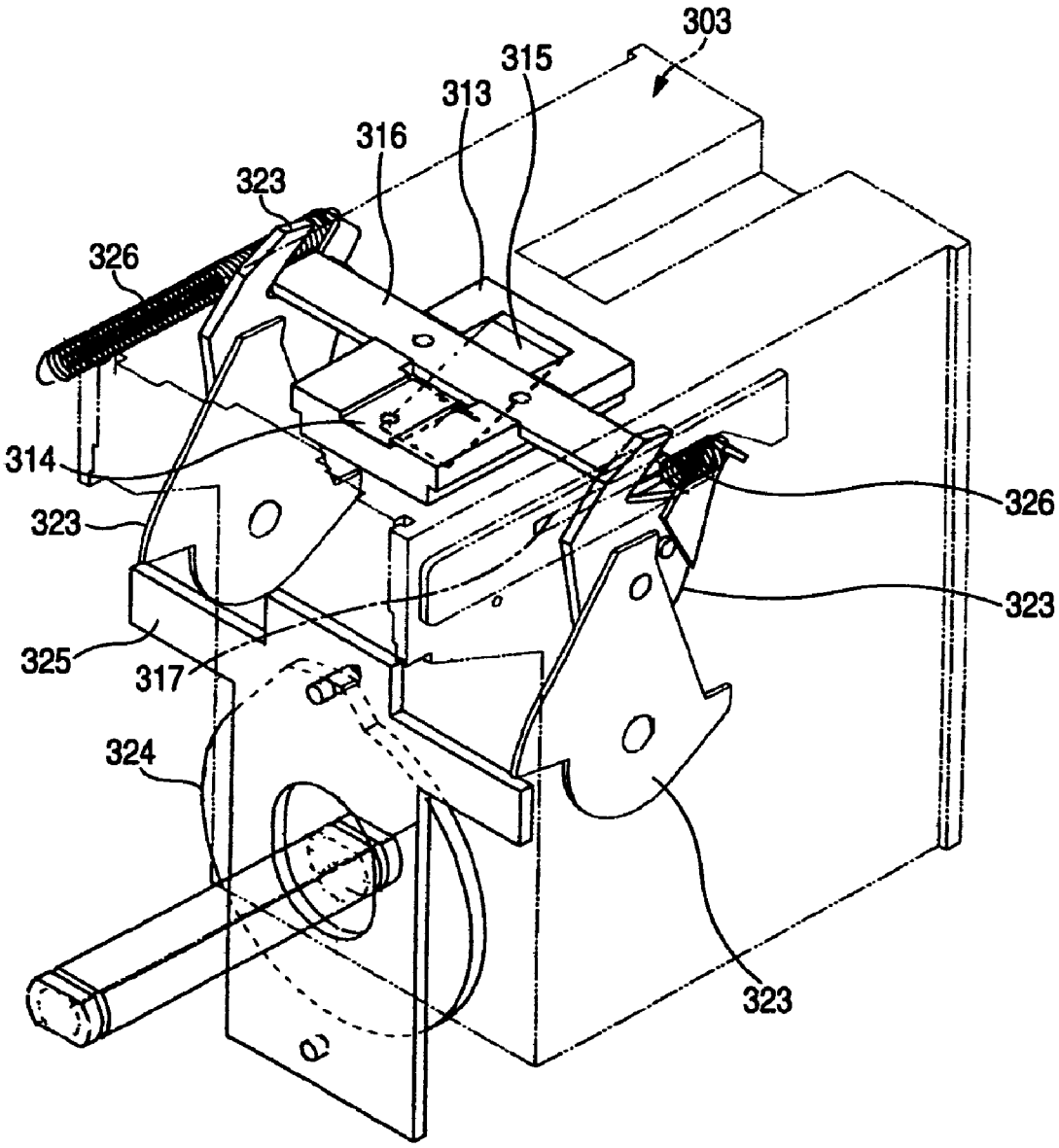
FIG. 16 is a perspective view showing a relationship between the staple cartridge and a staple feed mechanism of the driver unit.

As shown by FIG. 16, the two left and right end portions of the arm 316 are projected to outer sides by passing the grooves 317 formed at the staple cartridge 303 and a link lever 323 of the driver unit 301 pushes the arm 316 rearward to move back the slider 313 to a standby position. Numeral 324 designates a staple feed cam, numeral 325 designates a staple feed cam follower, numeral 326 designates a tension coil spring urging the link lever 323 frontward and in a stapling operation, by moving up and down the staple feed cam follower 325 by the staple feed cam 324 driven to rotate by a motor and pivoting the link lever 323 in accordance with the staple feed cam follower 325, the slider 313 of the staple cartridge 303 is cooperatively moved to move in one reciprocation in the front and rear direction. As shown by FIG. 15, a front portion of the leaf spring 313 is moved down from an upper face of the slider 313 in an initial state and when the slider 313 is moved forward, the slider 313 is brought into contact with a lower face of the leaf spring 311 to push up the leaf spring 311 and the staple guide 312 to an upper side.

Figure 17:
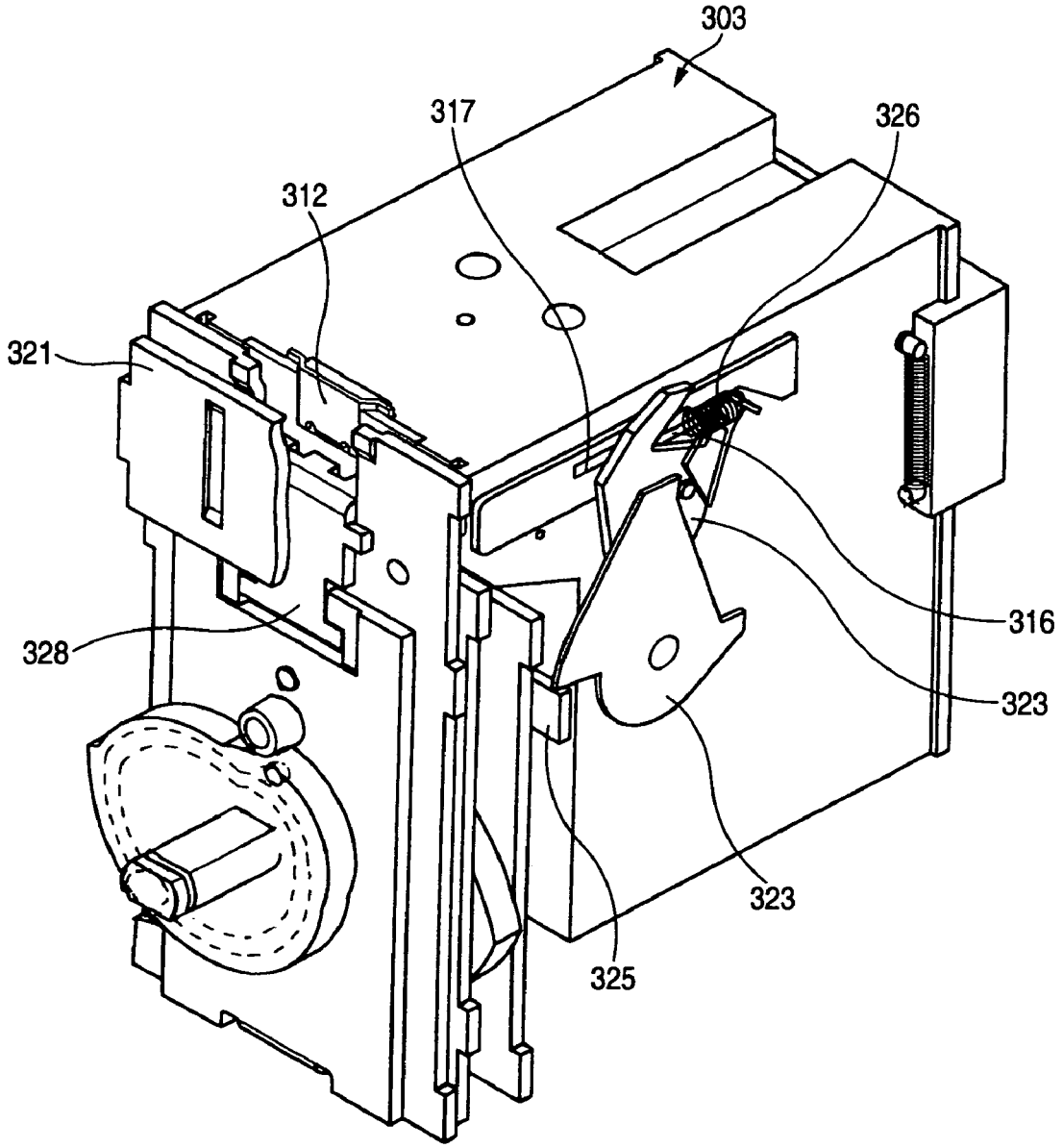
FIG. 17 is a perspective view of a state in which the staple cartridge is at standby.
Figure 18:
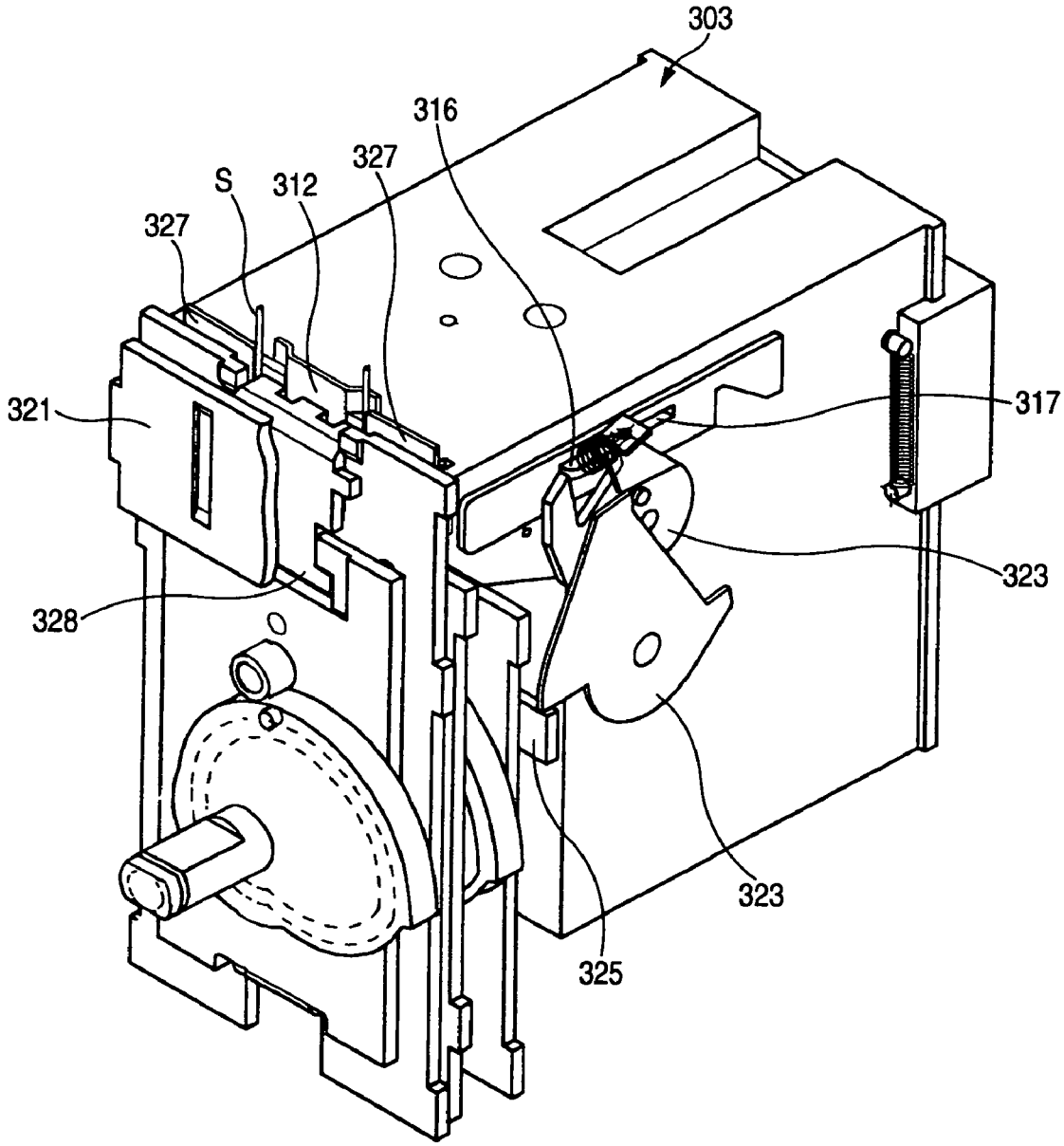
FIG. 18 is a perspective view showing a state of the staple cartridge immediately before striking a staple.

The drive mechanism of the electric stapler is constituted to carryout the operation of injecting the driver 322 successive to forward movement of the link lever 323, the slider 313 is pushed forward from an initial state shown by FIG. 15, FIG. 16 and FIG. 17, a topmost staple sheet is fed to the front side by the feed claw 315 and the slider 313 pushes the leaf spring 313 to push up the staple guide 312 to the upper side. Thereby, as shown by FIG. 18, the staple guide 312 is floated up to enter inside of the hole 342 of the sheet table 341 shown in FIG. 15 to be brought into contact with a lower face of paper (not illustrated) on the sheet table 341. Simultaneously therewith, a clincher unit (not illustrated) is moved down to press paper and a forming plate 327 is moved up to form the staple S in a U-shape.

Figure 19:
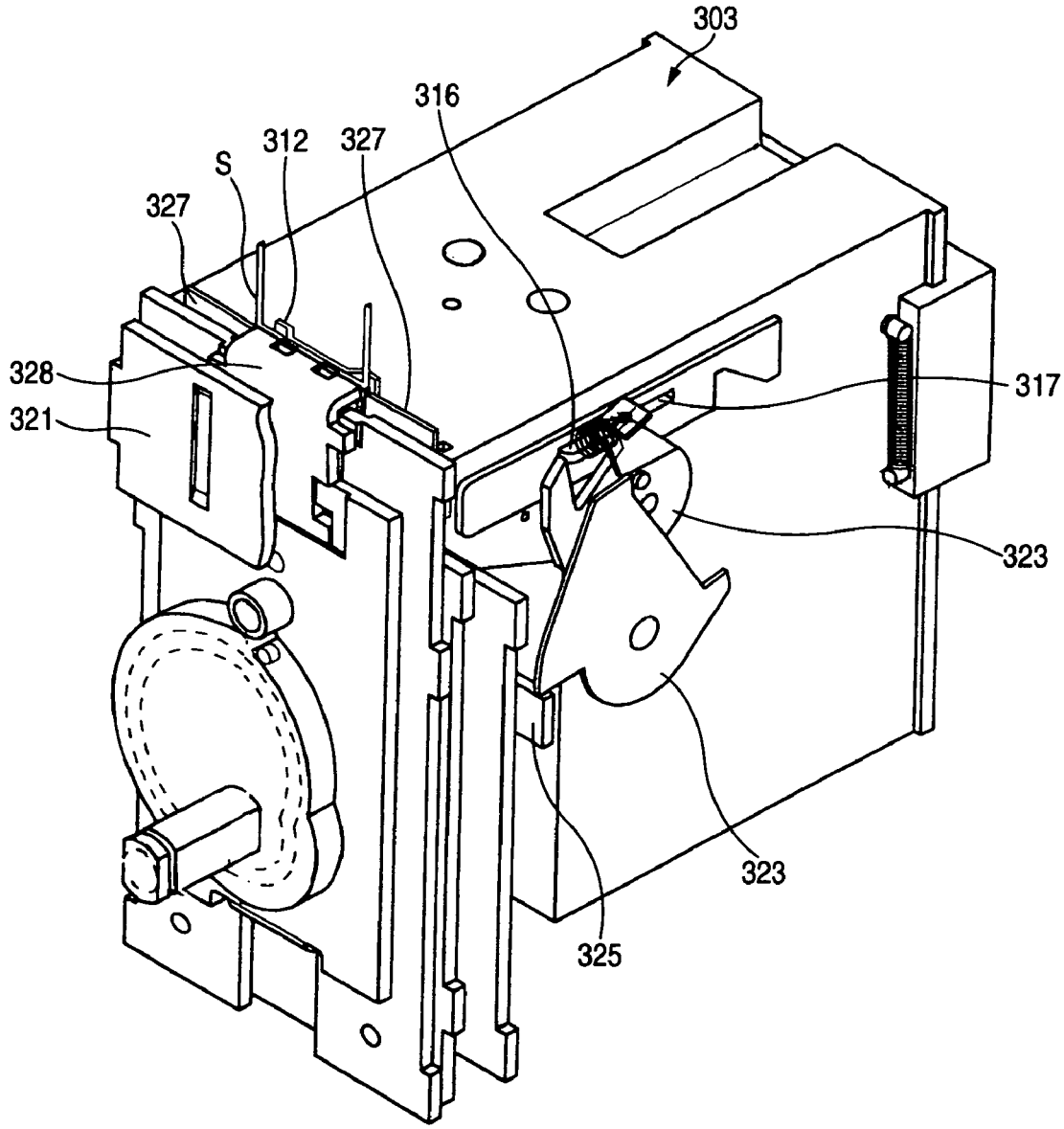
FIG. 19 is a perspective view showing a state of the staple cartridge in striking the staple.

Further, as shown by FIG. 19, an anvil 328 at a center supporting a crown portion of the staple S and the driver (not illustrated) disposed on the lower side are moved up further from the state of FIG. 18 and strike the staple S to paper. Thereafter, the forming plate 327 and the driver and the anvil 328 are moved down, the slider 313 is moved back to the initial position by the link lever 323, the leaf spring 313 attached with the staple guide 312 is moved down, and the staple guide 312 is escaped to the lower side from the hole 342 of the sheet table 341.

Although when the electric stapler of the background art in which a position of a staple guide in an up and down direction stays to be constant and the staple guide is not moved down from a hole is moved transversely by a feed mechanism, it is necessary to enable to move the electric stapler by forming a long hole connecting a plurality of stapling positions, according to the staple cartridge of the invention, the holes 342 having a necessary dimension may be formed only at a plurality of stapling positions of the sheet table 341 and a concern of catching paper fed from a copying mechanism portion onto the sheet table by the long hole is resolved. Further, since the feed claw 315 is attached to the slider 313 via the leaf spring 314, when a front staple is brought into contact with the face plate to stop, the leaf spring 314 is bent and the feed claw 315 is detached from the staple sheet and the slider 313 and the feed claw 315 move forward. Therefore, even when a number of staples of a topmost staple sheet is reduced and the feed claw 315 is moved back to the initial position and engaged with a second staple sheet, in a forward moving stroke, the slider 313 is not locked by engaging the feed claw 315 with the second staple sheet, a stroke of moving the slider 313 is always constant and the staple guide 312 can firmly be moved up.

Further, the invention is not limited to the above-described embodiment but can variously be modified within the technical range of the invention and the invention naturally covers the modifications.

The application is based on Japanese Patent Application (Japanese Patent Application No. 2001-350669) filed on Nov. 15, 2001, Japanese Patent Application (Japanese Patent Application No. 2001-353716) filed on Nov. 19, 2001 and Japanese Patent Application (Japanese Patent Application No. 2001-363321) filed on Nov. 28, 2001 and a content thereof is incorporated here by reference.

INDUSTRIAL APPLICABILITY

As has been explained above, the staple cartridge of the invention is constituted to be able to charge the staple by opening the door provided at the opening portion of the rear face and therefore, the staple can easily be refilled in the state of mounting the staple cartridge to the electric stapler.

Further, by constituting the door by the slide door and forming the slide door to return to the closing position by the spring, the door can simply be opened and closed and the operability is promoted.

Further, by forming the pressing plate at inside of the staple cartridge to move to the escaping position in cooperation with the slide door, the staple can be charged by only operating to open the door and the operability is further promoted.

Further, the staple cartridge of the invention is provided with the staple guide for guiding the driver of the electric stapler at the face on the feeding outlet side of the staple sheet, the driver path is constituted by opposing the staple guide to the face plate arranged at inside of the cartridge containing chamber of the electric stapler and therefore, in the case of clogging the staple, when the staple cartridge is removed from the electric stapler, the staple can simply be removed and jamming can simply be dealt with by dispensing with the operation of opening and closing the face plate in the staple cartridge of the background art.

Further, by arranging the magnet at the vicinity of the staple guide of the staple cartridge, the staple buckled at inside of the driver path is adsorbed by the magnet and therefore, the staple can further simply be removed.

Further, the staple cartridge of the invention is constituted such that the staple guide for restricting the attitude of injecting the staple is moved cooperatibly with the feed claw, in injecting the staple, the staple guide is moved into the hole of the sheet table to be brought into contact with paper and the staple guide comes out from the hole of the sheet table after injecting the staple and therefore, in constituting a moving type electric stapler for binding a plurality of locations of paper by moving a single piece of the staple unit, it is not necessary to provide the long hole at the sheet table over the moving distance. Therefore, the concern that an end portion of paper is brought into the long hole to constitute a hindrance in feeding paper as in the moving type electric stapler of the background art can be resolved and the stability is promoted.

The invention claimed is:

1. The staple cartridge, attachable to and detachable from a cartridge containing portion of an electric stapler, and capable of charging a staple pack containing stacked staple sheets adhered with linear staples in parallel with each other, comprising:

a staple pack containing chamber;

an opening portion formed at a side face of the staple pack containing chamber;

an openable and closable door provided at the opening portion;

wherein the staple pack is chargeable by opening the door in a state that the staple cartridge is attached to the cartridge containing portion of the electric stapler wherein the door is a slide door linearly slidable in an up and down direction, and the slide door is urged to a closing position by a spring.

2. The staple cartridge according to claim 1, further comprising:

a pressing plate brought into elastic contact with the staple sheet in the staple cartridge;

wherein an end portion of the pressing plate is projected to a path of moving the slide door, and when the slide door is slid so as to be opened, the slide door is engaged with the pressing plate and the pressing plate is movable with the slide door.

3. A staple cartridge, attachable to and detachable from a cartridge containing portion of an electric stapler and capable of charging a staple pack containing stacked staple sheets adhered with linear staples in parallel with each other, comprising:

a staple guide, provided on a side of feeding out the staple sheet, for guiding a driver of the electric stapler;

an opening portion; and a slide door provided at the opening portion and linearly urged to a closing position by a spring, wherein the staple guide is opposed to a face plate arranged at the cartridge containing portion of the electric stapler, and the staple guide and the face plate constitute a driver path.

* * * * *